US010355377B2

(12) United States Patent
Gerving et al.

(10) Patent No.: US 10,355,377 B2
(45) Date of Patent: Jul. 16, 2019

(54) ELECTRICAL SWITCHING DEVICE COMPRISING ELECTRICAL CLAMPING CONNECTIONS

(71) Applicant: EATON ELECTRICAL IP GMBH & CO. KG, Schoenefeld (DE)

(72) Inventors: Karsten Gerving, Bonn (DE); Ralf Thar, St. Augustin (DE); Sergei Eck, Diersdorf (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/560,492

(22) PCT Filed: Mar. 14, 2016

(86) PCT No.: PCT/EP2016/055447
§ 371 (c)(1),
(2) Date: Jan. 10, 2018

(87) PCT Pub. No.: WO2016/150743
PCT Pub. Date: Sep. 29, 2016

(65) Prior Publication Data

US 2018/0131106 A1 May 10, 2018

(30) Foreign Application Priority Data

Mar. 23, 2015 (DE) ..... 10 2015 104 268

(51) Int. Cl.
*H01R 4/48* (2006.01)
*H01R 9/24* (2006.01)
(Continued)

(52) U.S. Cl.
CPC ..... *H01R 4/4827* (2013.01); *H01R 9/2458* (2013.01); *H01R 9/2675* (2013.01);
(Continued)

(58) Field of Classification Search
CPC .... H01R 4/4827; H01R 11/09; H01R 4/4836; H01R 4/4845; H01R 4/22; H01R 9/26;
(Continued)

(56) References Cited

U.S. PATENT DOCUMENTS 4,739,293 A * 4/1988 Hurley ..... H01H 50/18 335/132
5,810,625 A 9/1998 Klein et al.
(Continued)

FOREIGN PATENT DOCUMENTS

CN 1155355 A 7/1997
CN 1787289 A 6/2006
(Continued)

OTHER PUBLICATIONS

Wago Kontakttechnik GmbH & Co. KG: In:—. Minden: Katalog Reihenklemmensysteme. Hauptkatalog Band 1 Ausgabe. 2012/2013. S.424.—Firmenschrift.

*Primary Examiner* — Edwin A. Leon
*Assistant Examiner* — Matthew T Dzierzynski
(74) *Attorney, Agent, or Firm* — Leydig, Voit & Mayer, Ltd.

(57) ABSTRACT

A clamping arrangement includes: two spring-force terminals, the two spring-force terminals each including a clamping cage and a spring, each of the two clamping cages being able to receive an electrical conductor pushed in an insertion direction and to clamp the conductor between the cage and the spring, a first insertion direction of a first of the two spring-force terminals and a second insertion direction of a second of the two spring-force terminals being arranged at an angle larger than 0° to one another. The two spring-force terminals are arranged one behind the other in one of the insertion directions of the electrical conductor. The first insertion direction of the first of the two spring-force terminals and the second insertion direction of the second of
(Continued)

the two spring-force terminals are arranged at a right angle to one another or counter to one another.

15 Claims, 10 Drawing Sheets

(51) Int. Cl.
*H01R 9/26* (2006.01)
*H01R 11/07* (2006.01)
*H01R 11/09* (2006.01)
*H01R 13/514* (2006.01)

(52) U.S. Cl.
CPC ..... *H01R 11/07* (2013.01); *H01R 11/09* (2013.01); *H01R 13/514* (2013.01)

(58) Field of Classification Search
CPC .... H01R 11/07; H01R 13/506; H01R 13/514; H01R 13/74; H01R 43/16; H01R 4/34; H01R 4/48; H01R 4/4809; H01R 4/4818; H01R 9/2458; H01R 9/2491; H01R 9/2675; H01H 1/5844; H01H 71/08
See application file for complete search history.

(56) References Cited

U.S. PATENT DOCUMENTS

| | | | | |
|---|---|---|---|---|
| 6,806,424 | B2 * | 10/2004 | Gerving | H01R 4/34 174/135 |
| 7,104,833 | B2 * | 9/2006 | Oesterhaus | H01R 4/4836 439/441 |
| 7,438,587 | B2 * | 10/2008 | Germani | H01R 4/4836 439/441 |
| 7,474,194 | B2 * | 1/2009 | Darr | H01H 9/104 337/59 |
| 7,609,137 | B2 * | 10/2009 | Roesner | H01H 71/08 200/293 |
| 7,794,268 | B2 * | 9/2010 | Breen, IV | H01R 4/22 439/439 |
| 8,466,367 | B2 * | 6/2013 | Reibke | H01R 4/4827 174/135 |
| 9,859,081 | B2 * | 1/2018 | Fasano | H01H 71/08 |
| 9,905,943 | B2 * | 2/2018 | Herrmann | H01R 4/4836 |
| 9,954,331 | B2 * | 4/2018 | Peach | H01R 9/2666 |
| 10,062,976 | B2 * | 8/2018 | Hoppe | H01R 4/4836 |
| 2004/0020678 | A1 | 2/2004 | Gerving | |
| 2005/0270130 | A1 | 12/2005 | Roesner et al. | |
| 2006/0128206 | A1 | 6/2006 | Oesterhaus | |
| 2009/0017699 | A1 | 1/2009 | Breen, IV | |
| 2011/0073364 | A1 | 3/2011 | Reibke | |
| 2016/0211591 | A1 | 7/2016 | Herrmann et al. | |

FOREIGN PATENT DOCUMENTS

| | | | |
|---|---|---|---|
| CN | 102037611 | A | 4/2011 |
| DE | 29606759 | U1 | 6/1996 |
| DE | 10023851 | A1 | 11/2001 |
| DE | 10236790 | C1 | 10/2003 |
| DE | 10244480 | A1 | 4/2004 |
| DE | 20313855 | U1 | 1/2005 |
| DE | 202009011828 | U1 | 1/2011 |
| DE | 102012110895 | A1 | 5/2014 |
| DE | 102014113086 | A1 | 3/2015 |
| EP | 1865577 | A2 | 12/2007 |
| EP | 2752944 | A2 | 7/2014 |
| WO | WO 2009141084 | A1 | 11/2009 |
| WO | WO 2014075967 | A1 | 5/2014 |

* cited by examiner

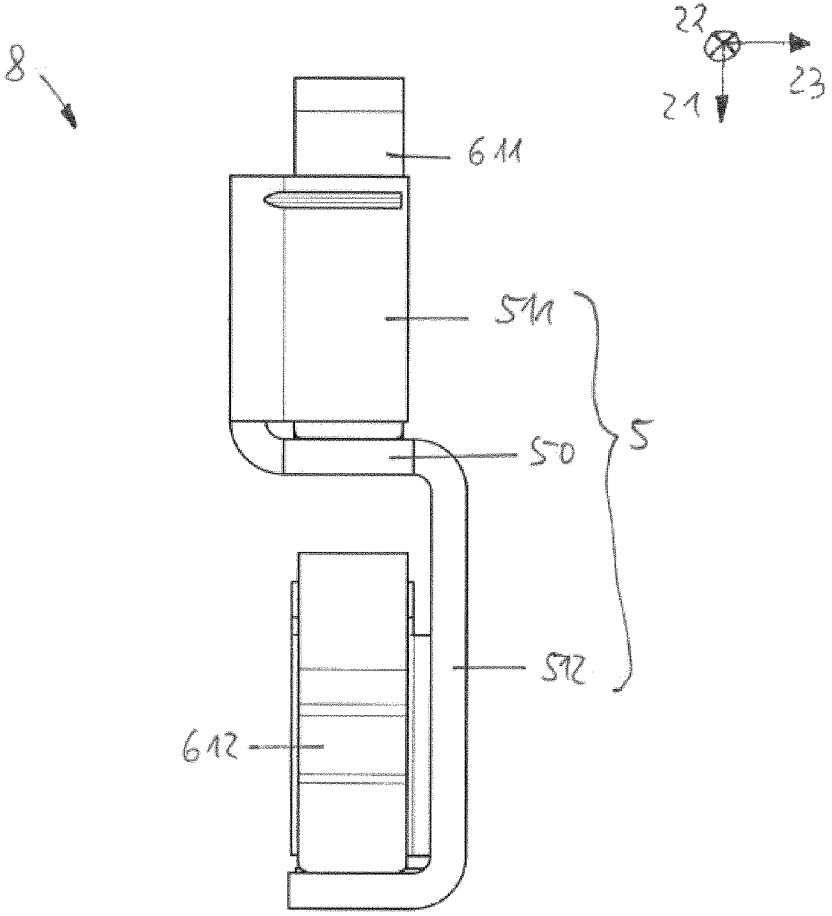
Fig. 1 (8)

ELECTRICAL SWITCHING DEVICE COMPRISING ELECTRICAL CLAMPING CONNECTIONS

CROSS-REFERENCE TO PRIOR APPLICATIONS

This application is a U.S. National Phase application under 35 U.S.C. § 371 of International Application No. PCT/EP2016/055447, filed on Mar. 14, 2016, and claims benefit to German Patent Application No. DE 10 2015 104 268.1, filed on Mar. 23, 2015. The International Application was published in German on Sep. 29, 2016 as WO 2016/150743 under PCT Article 21(2).

FIELD

The present invention relates to a spring-force terminal comprising a clamping cage, a spring and an operating element for opening the spring, to a clamping arrangement comprising at least two spring-force terminals, and to an electrical switchgear, in particular a power switch, a protective motor switch, a contactor or a relay, comprising a clamping arrangement of this kind.

BACKGROUND

Switchgears such as power switches, protective motor switches, relays or contactors are used for protection from electrical loads and/or to switch the loads on, for example motors, lighting systems, manufacturing units or the like, preferably if large electrical loads are intended to be switched. In industrial applications, switchgears of this kind are often integrated into distribution boards. Here they are often interchangeably connected to bars in series, or fastened, in particular screwed, to distribution board walls provided therefor.

Electrical conductors are connected after arrangement in the distribution board in most cases by means of push-in terminals from the front, i.e. on top of the switchgear, or by means of screw terminals from above or below, i.e. on the width or length side of the switchgear. When push-in terminals are used, often two or more electrical conductors are connected together. However, this is often not possible in the case of electrical conductors having a large line cross-section.

In order to optimize the connection options for a switchgear, DE 102 36 790 C1 discloses a switchgear which has a plurality of connection contacts for connecting electrical conductors and in which at least one of the connection contacts comprises a connection for a second electrical conductor. The connection is designed as a central receiving hole for receiving a push-in contact.

DE 10 2014 113 086 A1 discloses a series-connection apparatus comprising at least two connection modules that comprise a clamping cage and a common busbar, each of which is made of a flat strip such that the clamping cage can be made of a highly conductive material, and the connection modules and the series-connection apparatus can still be made cost-effectively. DE 203 13 855 U1 discloses a connection apparatus comprising a busbar on which a plurality of spring legs for connecting electrical conductors are arranged. In these documents, the connection modules or the spring legs may be arranged at an angle to one another.

The WAGO main catalogue entitled "Reihenklemmensysteme" (volume 1, edition 2012/2013) discloses a series-connection apparatus comprising a plurality of push-in terminals arranged in series and at an angle to one another.

In DE 102 44 480 A1, two cage tension springs are arranged in a terminal block one above the other and in a manner laterally offset from one another. In DE 100 23 851 A1 too, the resilient clamping means of a connection terminal are arranged one above the other but in a manner offset from one another.

DE 296 06 759 U1 discloses a multi-part housing for low-voltage switchgears for receiving screw terminals, the connector plugs of which are arranged in the region of step-shaped gradations.

SUMMARY

In an embodiment, the present invention provides a clamping arrangement comprising: two spring-force terminals, the two spring-force terminals each comprising a clamping cage and a spring, each of the two clamping cages being configured to receive an electrical conductor pushed in an insertion direction and to clamp the conductor between the cage and the spring, a first insertion direction of a first of the two spring-force terminals and a second insertion direction of a second of the two spring-force terminals being arranged at an angle larger than 0° to one another, wherein the two spring-force terminals are arranged one behind the other in one of the insertion directions of the electrical conductor, and wherein the first insertion direction of the first of the two spring-force terminals and the second insertion direction of the second of the two spring-force terminals are arranged at a right angle to one another or counter to one another.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
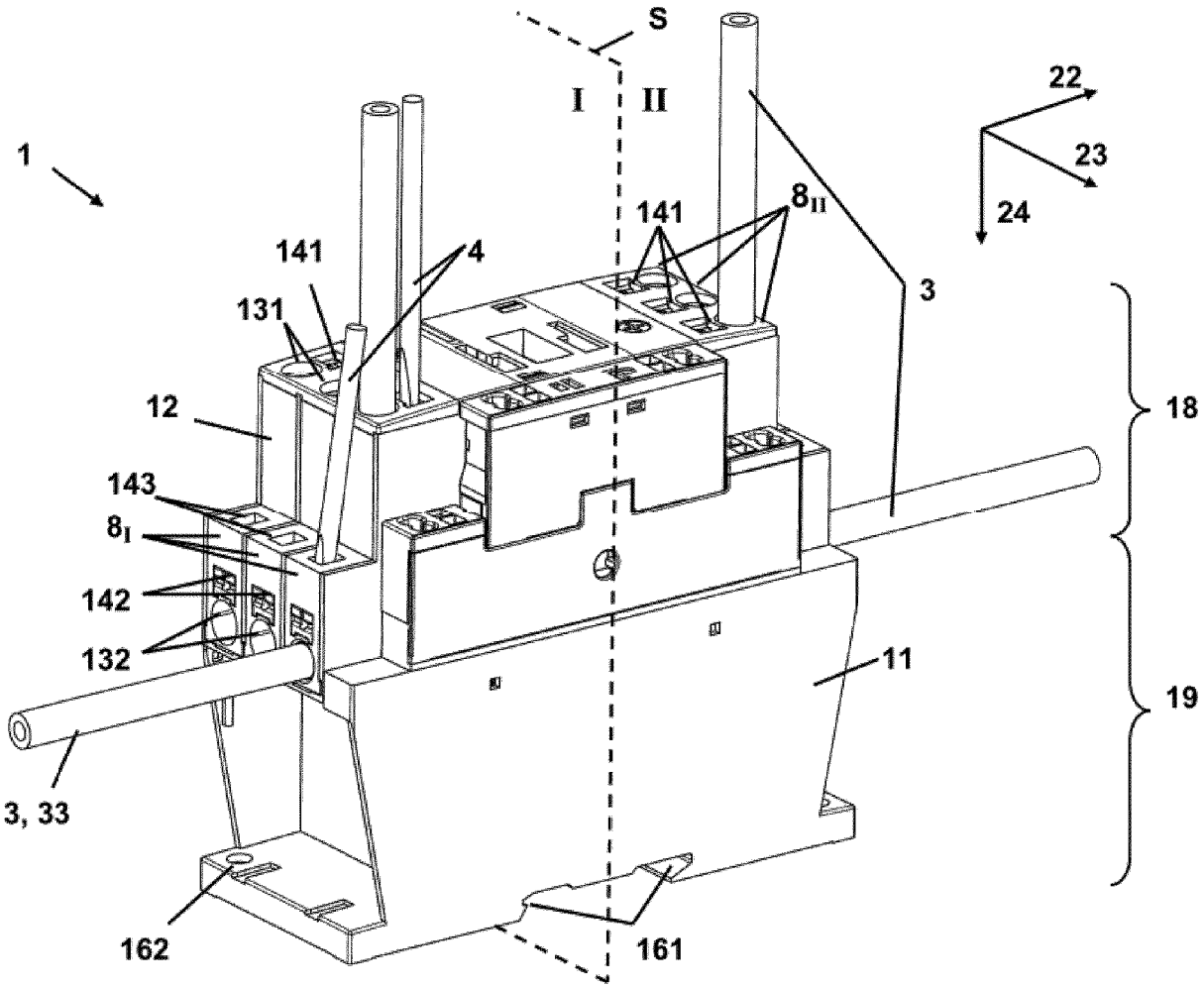
FIG. 1(*a*) is a perspective view of an embodiment of an electrical switchgear, 1(*b*) is a sectional image of a detail from the electrical switchgear from 1(*a*), 1(*c*) and 1(*d*) are each a further sectional image of a detail from the electrical switchgear, these details each showing a clamping arrangement of the switchgear, and 1(*e*) to 1(*g*) each shows the clamping arrangement.
Figure 1B:
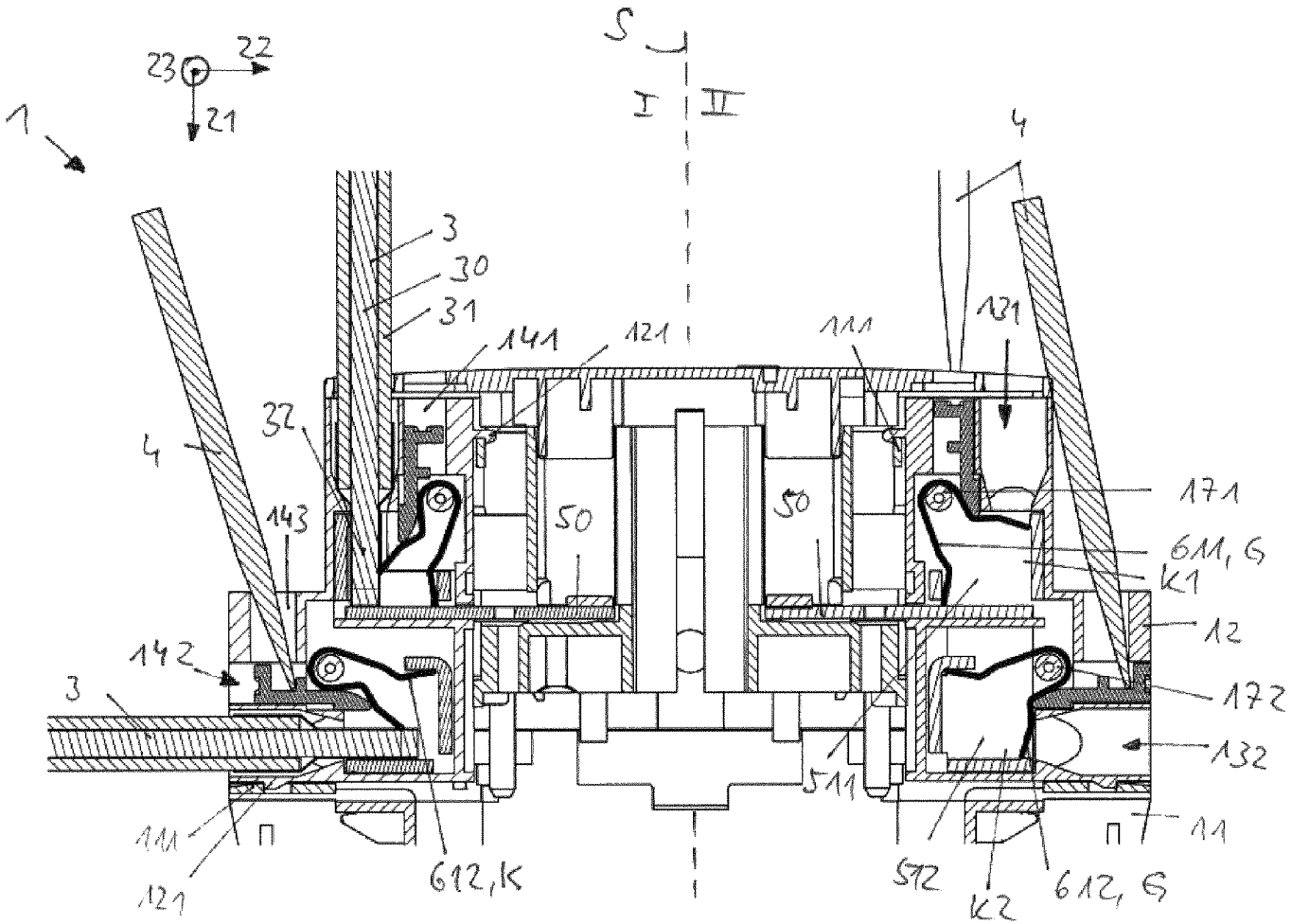
Figure 1C:
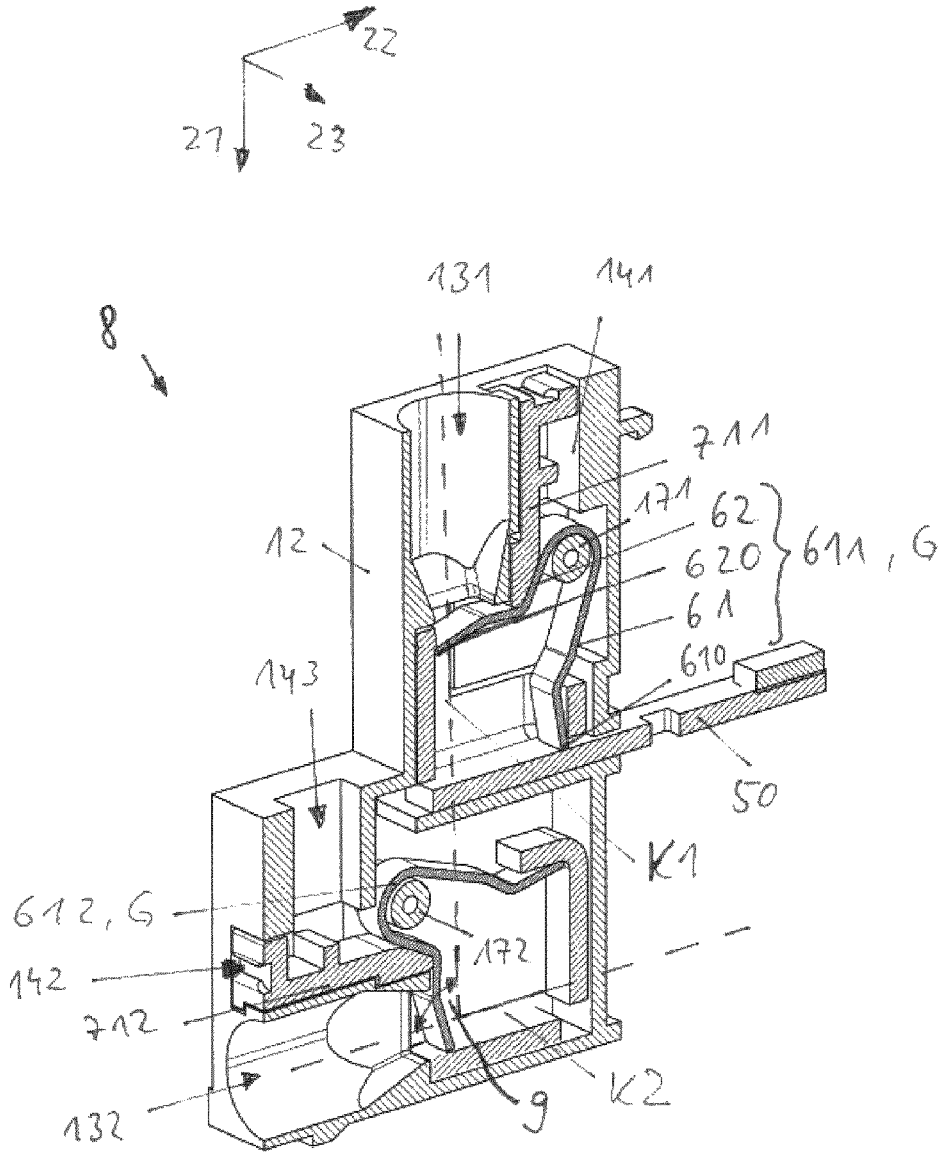
Figure 1D:
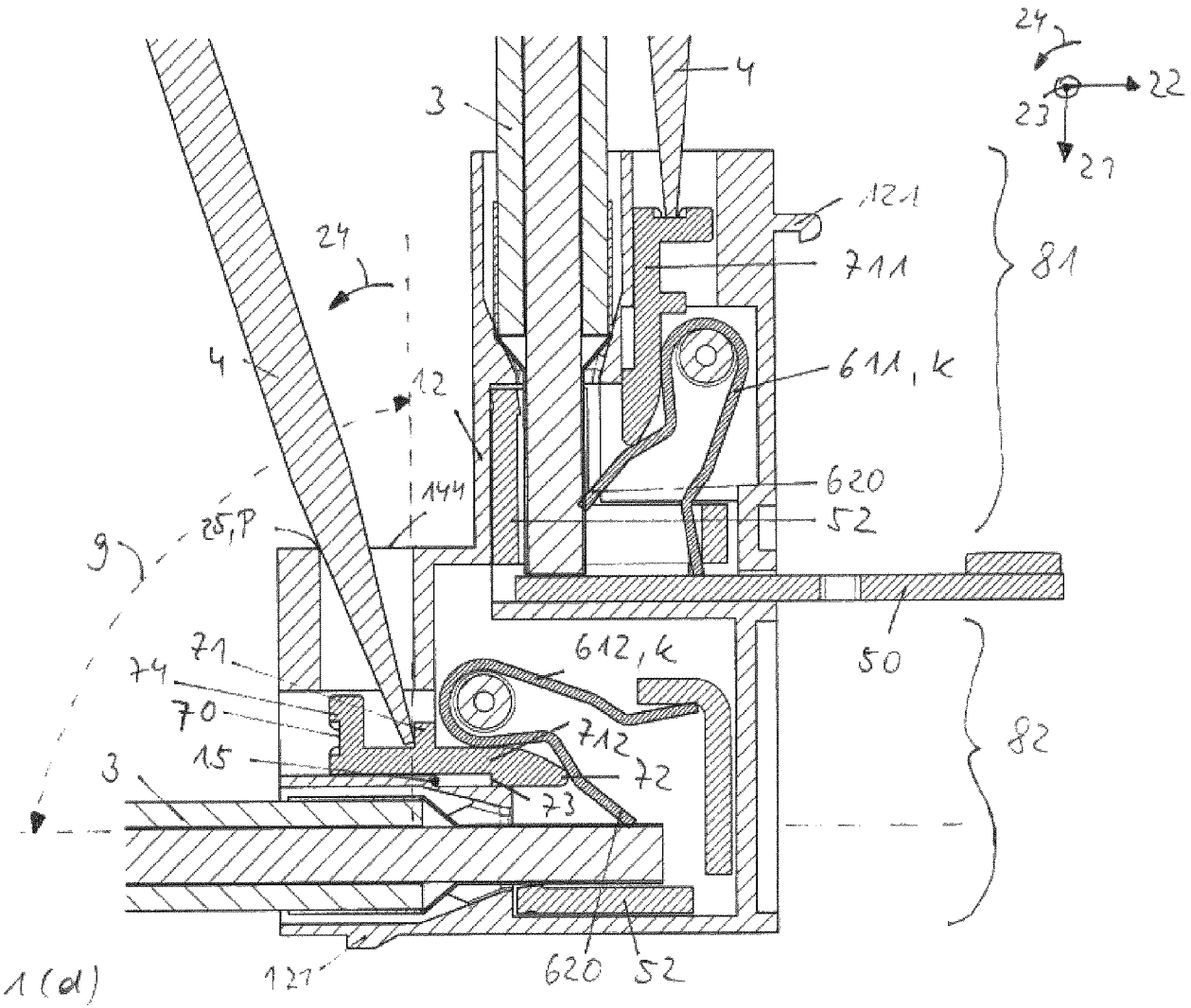
Figure 1:
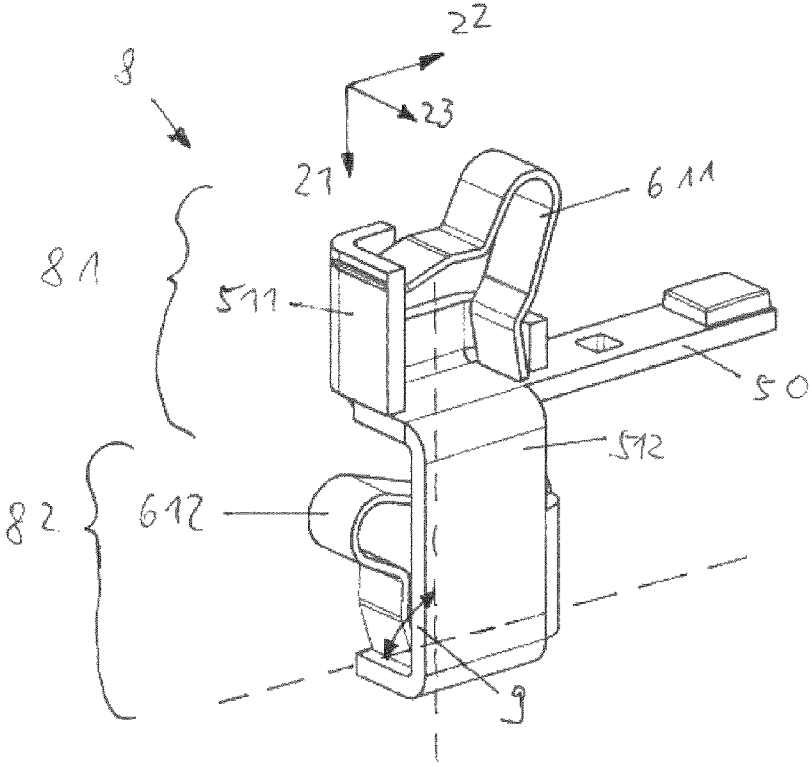
Figure 1F:
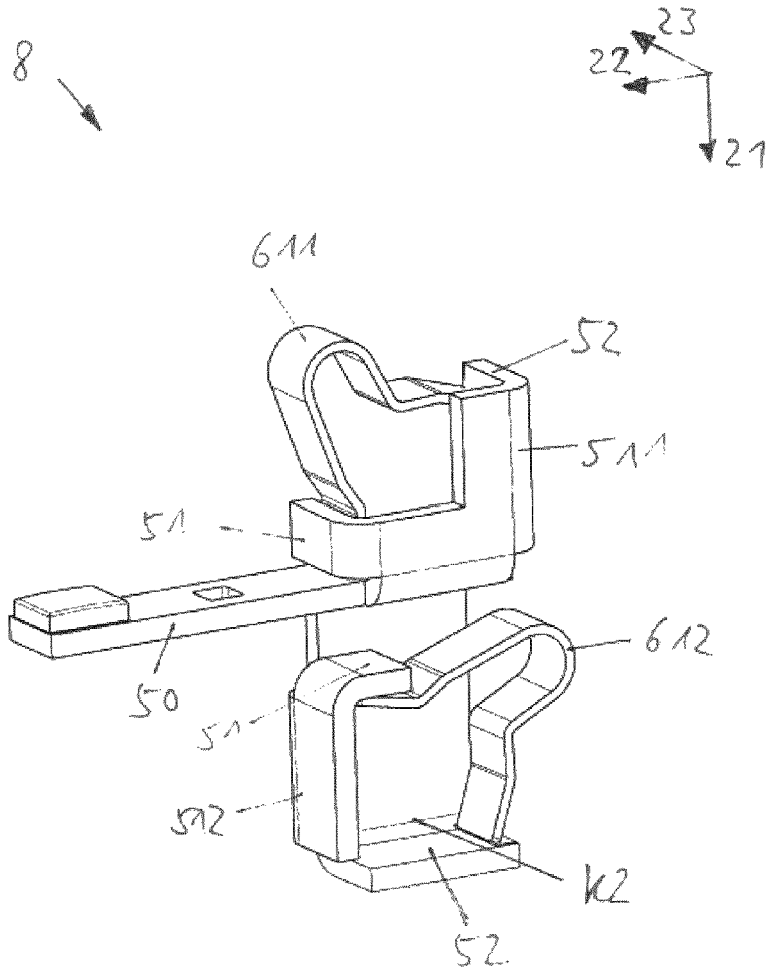

In an embodiment, the present invention provides an electrical switchgear of which the operability and connection options are further improved whilst maintaining or reducing the installation space required, which in particular allows options for connecting at least two or more electrical conductors having a large line cross-section, which is easy to manipulate, in particular with respect to installation in a cramped distribution board, and which can also be produced cost-effectively.

In an embodiment, the present invention provides a clamping arrangement comprising two spring-force terminals.

The two spring-force terminals each comprise a clamping cage and a spring, it being possible to push an electrical conductor into each of the two clamping cages in an insertion direction and to clamp said conductor between said cage and the spring. One of the two spring-force terminals, the clamping cage thereof and the spring thereof will be referred to below as the first spring-force terminal, the first clamping cage and the first spring, respectively. The other of the two spring-force terminals, the clamping cage thereof and the spring thereof will be referred to below as the second spring-force terminal, the second clamping cage and the second spring, respectively.

The first insertion direction of the first spring-force terminal and the second insertion direction of the second spring-force terminal are arranged at an angle to one another that is larger than 0°. As a result, the user can choose between two operating directions. The clamping arrangement is distinguished in that the first insertion direction of the first spring-force terminal and the second insertion direction of the second spring-force terminal are arranged at a right angle to one another or counter to one another, for example so as to be opposite one another with respect to an imaginary line of symmetry.

Two electrical conductors can be inserted into said clamping arrangement independently of one another, specifically the first electrical conductor into the first spring-force terminal, and the second electrical conductor into the second spring-force terminal. In the process, the electrical conductor inserted into the first spring-force terminal and the electrical conductor inserted into the second spring-force terminal do not interfere with one another, since they are arranged so as to be positionally separate from one another. Furthermore, both electrical conductors having a small line cross-section and those having a large line cross-section can be used. In particular, electrical conductors having wire end ferrules having a plastics collar can also be used.

Overall, the clamping arrangement allows spatial separation, which is advantageous in terms of the clear arrangement and the ease of connection of the electrical conductors. The clamping arrangement also makes it possible to use only one of the two spring-force terminals, it then being possible to select the insertion direction depending on the spatial conditions, and an electrical conductor then being pushed either into the first spring-force terminal in the first insertion direction, or into the second spring-force terminal in the second insertion direction and at the angle to the first insertion direction. Therefore, a larger number of electrical conductors can be connected to the clamping arrangement, specifically at least two or, in the case of double-crimped electrical conductors, even more, or electrical conductors having a larger line cross-section can be used if each of the two spring-force terminals is used for only one electrical conductor, or the insertion direction can be selected if only one of the two spring-force terminals is used and the clamping arrangement is therefore easier to manipulate, in particular in cramped spatial conditions.

Spring-force terminals comprising tension springs and spring-force terminals comprising compression springs are preferred.

The clamping arrangement is also distinguished in that the two spring-force terminals are arranged one behind the other in the first insertion direction or in the second insertion direction of the electrical conductor. This makes it possible to arrange the two spring-force terminals in a nested manner, thus saving space. It is particularly preferred for the spring-force terminals to overlap at least in part or even to be arranged one above the other.

The two spring-force terminals are preferably arranged at the right angle to one another or so as to be mirrored or rotated through 180° with respect to one another. Structurally, these embodiments can be easily produced, and they require only little installation space.

The spring-force terminals are also preferably arranged on opposite sides of a busbar. In the embodiment of the clamping arrangement in which the spring-force terminals are each arranged opposite one another at an angle of 90° to the busbar (i.e. so as to be rotated through 180° with respect to one another), the spring-force terminals are particularly preferably arranged so as to be in mirror symmetry with respect to the busbar.

In a particularly preferred embodiment, the clamping arrangement comprises a busbar that is electrically conductively connected to the two clamping cages. At least two electrical conductors can be connected to the same busbar. The busbar is therefore a common busbar. The first clamping cage of the first spring-force terminal and the second clamping cage of the second spring-force terminal are preferably arranged on opposite sides of the busbar. As a result, the installation width of the clamping arrangement is very small, and the installation space is used optimally. This embodiment nevertheless makes it possible to connect electrical conductors having a relatively large line cross-section.

In a first preferred embodiment, the two clamping cages of the spring-force terminals are made in one piece with the busbar. In this embodiment, the clamping cages and the busbar can be produced cost-effectively from a flat strip material as stamped-bent parts. In a second preferred embodiment, the clamping cages of the spring-force terminals are connected to the busbar in an integrally bonded manner. As a result, various materials can be used for the clamping cages, in particular a highly conductive material such as copper for the busbar and a harder but cheaper metal for the clamping cages.

In a further embodiment, the two spring-force terminals each comprise an operating element for opening the spring. In this case, it is preferred for it to be possible to move each of the operating elements in the insertion direction associated with the spring-force terminal thereof. More particularly preferably, at least one of the operating elements can also be actuated at the angle to the insertion direction associated with the spring-force terminal thereof. The operating element of said spring-force terminal can therefore be actuated in both the first insertion direction and the second insertion direction. Said spring-force terminal therefore also allows for highly flexible manipulation on the part of the user when the electrical conductor inserted into said spring-force terminal is released.

The clamping arrangement also preferably comprises a housing. The housing is designed to protect the user from contact by touch, preferably designed as an insulant housing, and is preferably made of a plastics material. An insertion opening for inserting the electrical conductor and an actuation opening for actuating the operating element, in particular for inserting the tool, are preferably provided in the housing for each of the two spring-force terminals. A clamping point of the spring-force terminals is accessible from the outside via each of the insertion openings. The operating element of the spring-force terminals is accessible from the outside via each of the actuation openings.

In the embodiment of the clamping arrangement in which the spring-force terminals are arranged at the right angle to one another, the insertion opening and the actuation opening of the same spring-force terminal are preferably arranged in parallel with one another and at the right angle to the insertion opening and the actuation opening of the other spring-force terminal. In the embodiment of the clamping arrangement in which the spring-force terminals are arranged opposite one another each at the angle of 90° to the busbar, the insertion opening and the actuation opening of the same spring-force terminal are preferably arranged in parallel with one another and opposite the insertion opening and the actuation opening of the other spring-force terminal.

In a particularly preferred embodiment, the spring-force terminals are arranged on opposite sides of the busbar at the right angle to one another or at the angle of 180°. As a result, spring-force terminals having substantially the same structure can be used. More particularly preferably, the spring-force terminals are arranged on opposite sides of the common busbar, in particular one above one the other, either at the right angle to, or at the angle of 180° to, in particular in mirror symmetry with, one another.

If the clamping arrangement comprises the at least one spring-force terminal having the operating element that can be operated from two directions, the housing for said spring-force terminal preferably also comprises the second actuation opening, which extends at the angle to the insertion opening associated with the spring-force terminal thereof.

In a particularly preferred embodiment, the same springs and/or operating elements can be used for the two spring-force terminals. As a result, the range of components is small, and the costs for the clamping arrangement are lower than for a clamping arrangement having a wider range of components.

In an embodiment, the invention provides a spring-force terminal comprising a clamping cage, a spring and an operating element for opening the spring. Said terminal comprises a first actuation opening that extends in parallel with the insertion direction. An electrical conductor can be pushed into the clamping cage in an insertion direction. The electrical conductor can be removably clamped between the clamping cage and the spring. The operating element can be moved in and counter to the force of the spring in the insertion direction, in particular in order to release the electrical conductor clamped in the spring-force terminal. It is preferred for the electrical conductor clamped in the clamping cage to be removable from the clamping cage by moving the operating element counter to the force of the spring in the insertion direction.

The spring-force terminal is distinguished in that it also comprises a second actuation opening that extends at a right angle to the first actuation opening. By means of the second actuation opening, the operating element can be actuated at the right angle to the insertion direction. The operating element can therefore be actuated both in the insertion direction and at the right angle to the insertion direction. In cramped spatial conditions, there is not only one option for operation available to a user, but rather said user has a choice between two directions. This may make it considerably easier to manipulate the spring-force terminal, in particular in cramped spatial conditions.

In order to be actuated in the first insertion direction and at the right angle to the insertion direction, the operating element preferably comprises a first means and a second means, respectively. The means are preferably designed to be actuated by a tool. However, a means for actuating the operating element by hand in at least one of the two or both directions is also preferred.

The first means is preferably designed as a recess, in particular a notch, and is provided for a tool to engage therein. The second means is preferably designed as an integrally formed portion, in particular as an edge or a web, and is provided for the tool to be placed thereagainst. In order to actuate the operating element, the tool is placed in the notch and the operating element is then moved in the insertion direction by means of the tool.

Alternatively, the tool is placed against the integrally formed portion at the angle to the insertion direction, and the operating element is subsequently moved in the insertion direction by means of a lever movement of the tool. Preferably, for this purpose a screwdriver is used as the tool. On account of the lever movement, the force that has to be exerted is very low.

In an embodiment, the invention provides a switchgear, in particular a power switch, a protective motor switch, a contactor or a relay, comprising at least one clamping arrangement of this kind. In one embodiment, the switchgear comprises two clamping arrangements of this kind. In this case, it is preferred for the two clamping arrangements to be arranged in mirror symmetry with respect to a mirror plane, which is in particular arranged at the center of the switchgear. The clamping arrangement or the clamping arrangements make it possible to connect, in each case, two electrical conductors, specifically electrical conductors having a larger line cross-section, and/or allow easy manipulation by the spring-force terminal that is easier to reach/actuate being selected.

The switchgear preferably comprises an electrical assembly that is provided to protect an electrical load. An electrical network, for example a power network, can be connected to the switchgear. However, an electrical switchgear to which a different network can be connected, for example a communication network, is also preferred.

The electrical switchgear comprises an incoming electrical connection and an outgoing electrical connection for at least one electrical network line in the network, preferably for all the electrical network lines in the network. It is preferred for the electrical assembly to be arranged between the incoming and outgoing electrical connections. Said electrical assembly is preferably designed as or comprises a switch for opening or closing an electrical connection between the incoming and outgoing connections.

It is preferred for the incoming connection and/or the outgoing connection to be designed as a clamping arrangement of this kind. Particularly preferably, both the incoming connection and the outgoing connection are designed as a clamping arrangement of this kind. More particularly preferably, the incoming connection and the outgoing connection of the same network line are arranged in mirror symmetry with respect to the mirror plane.

It is preferred for the switchgear to comprise a housing upper part and a housing lower part, the clamping arrangement or the clamping arrangements being arranged in the upper housing part, and the electrical assembly being arranged in the lower housing part. In addition to the clear separation of the connection technology from the electrical assembly, the clamping arrangements of said switchgear are also easily accessible to the user.

The electrical switchgear is very easy to manipulate in the cramped interior of a distribution board, since said switchgear makes it possible to connect one or two electrical conductors in the first and/or the second insertion direction. If only one single electrical conductor is to be connected to the incoming or outgoing connection, this gives the user the choice of whether to connect said conductor in the insertion direction or at the angle to the insertion direction depending on the insertion direction in which it appears easier for the user to manipulate. Since each of the clamping arrangements comprises two spring-force terminals for the incoming and/or outgoing connections, electrical conductors having a large line cross-section can be connected to the electrical switchgear. Nevertheless, the electrical switchgear only requires a small installation width on account of the spring-force terminals being arranged on opposite sides of the busbar. It is also easy to open the spring of the spring-force terminals and therefore to release the conductors clamped in said terminals. This applies even more so to a spring-force terminal having an operating element that can be operated via both the first actuation opening and the second actuation opening.

Figure 2:
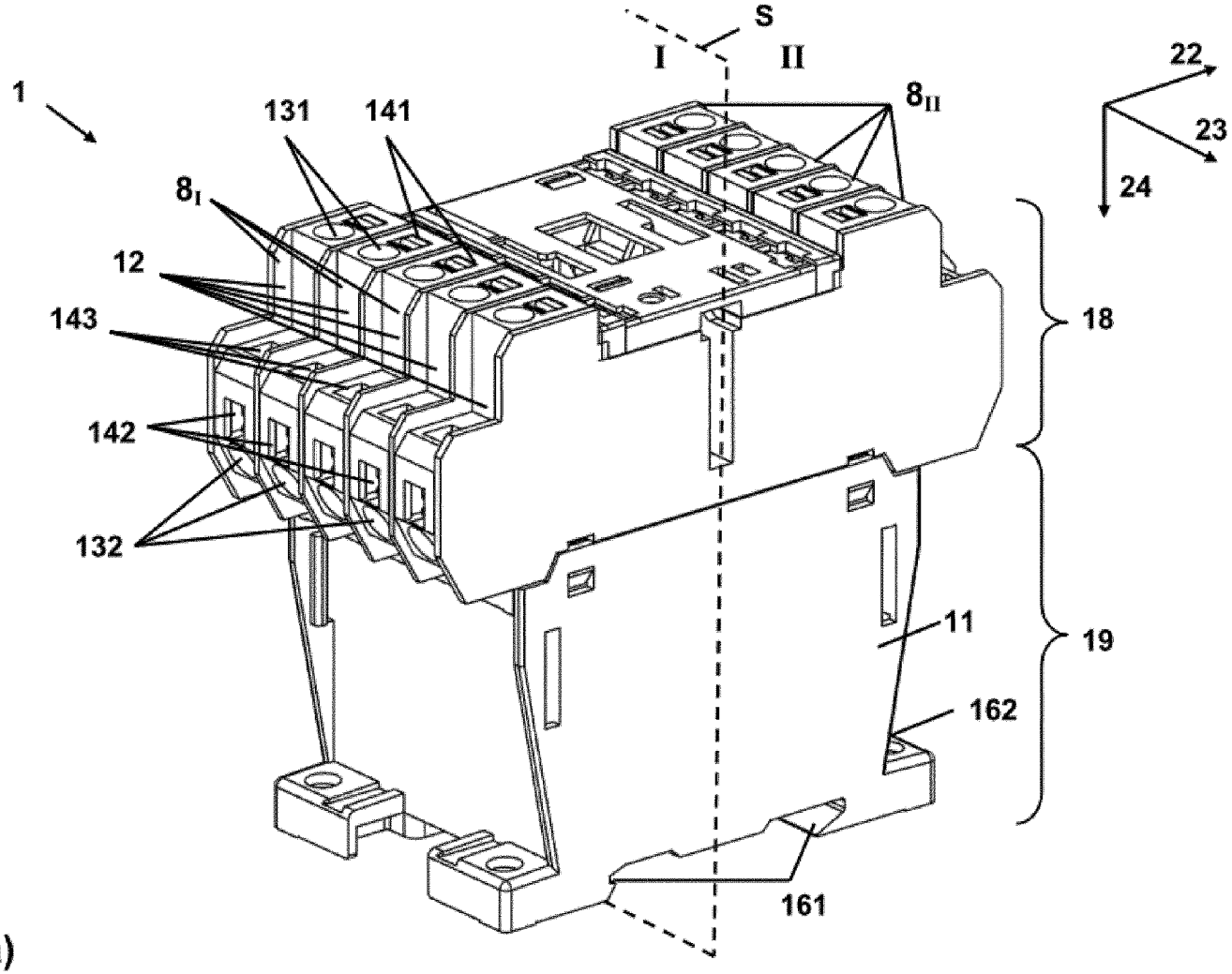
FIGS. 2(*a*) and 2(*b*) show a further embodiment of an electrical switchgear, specifically 2(*a*) is a perspective view and 2(*b*) is a sectional image of a detail from 2(*a*)
Figure 2B:
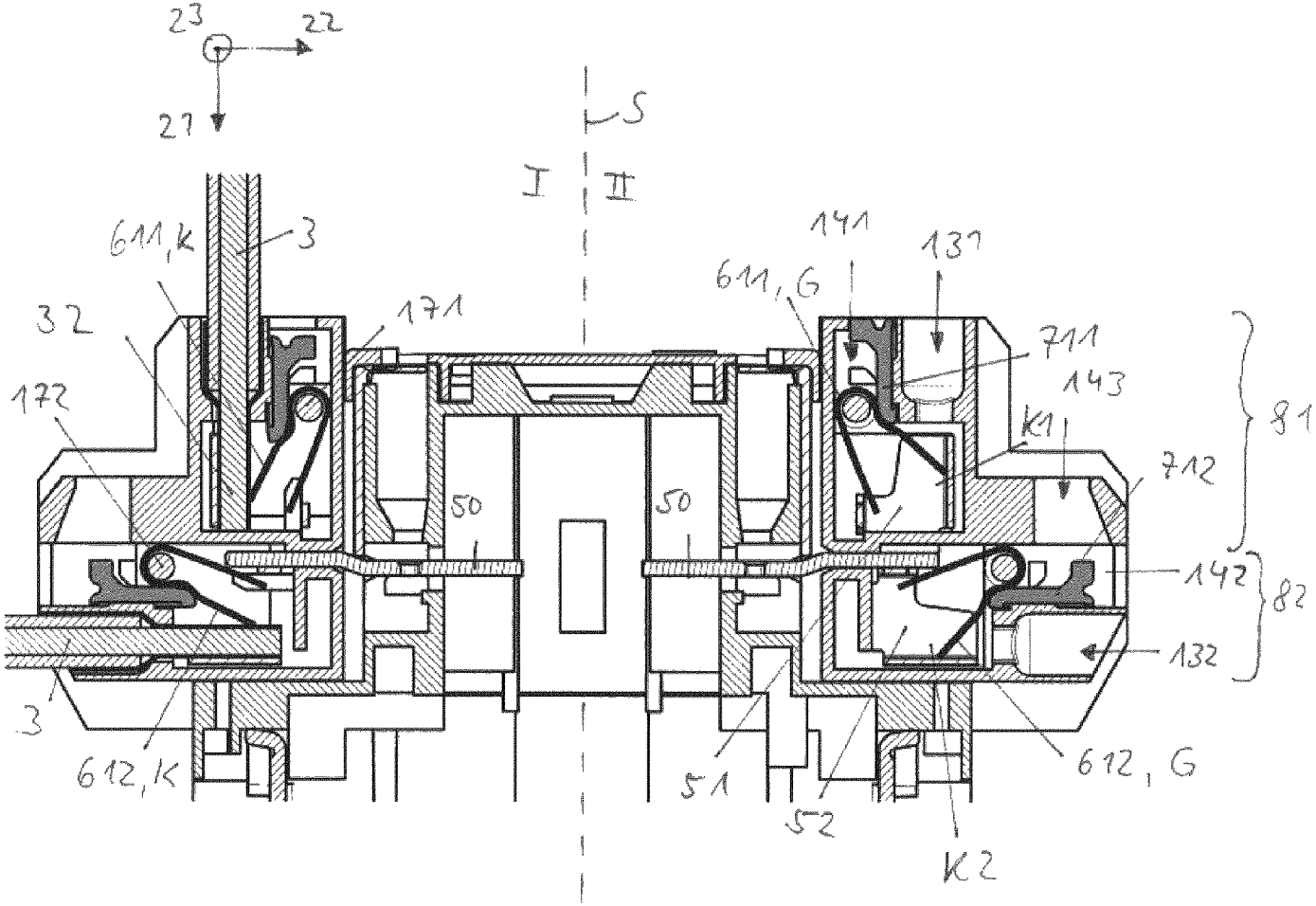

The electrical switchgears 1 in FIGS. 1 and 2 each comprise a housing 11 having an upper housing part 18, in which the connection technology for connecting electrical conductors 3 to the switchgears 1 is arranged, and a lower housing part 19, in which an electrical assembly is arranged in each case. The switchgears 1 are provided so as to be arrangeable in series on a busbar in a series-arrangement direction 23 by means of joining means 161, or can be arranged on a distribution board wall by means of fastening means. By way of example, through-holes 162 for screwing down the electrical switchgear 1 are shown in FIG. 1(*a*) for this purpose.

In the following, the invention will be described initially with reference to the electrical switchgear 1 in FIG. 1. Subsequently, the differences between the embodiment in FIG. 2 and that in FIG. 1 will be addressed.

Electrical network lines 33 of a power network can be connected to the electrical switchgear 1 in FIG. 1. For this purpose, the switchgear 1 comprises an incoming connection $\mathbf{8}_I$ and an outgoing connection $\mathbf{8}_{II}$ for each of a plurality of network lines 33, in this case for each of three network lines. The incoming and outgoing connections $\mathbf{8}_I$, $\mathbf{8}_{II}$ are arranged in mirror symmetry with respect to an imaginary mirror plane S extending through the center of the switchgear 1. The mirror plane S divides the electrical switchgear 1 into a first switchgear part I having the incoming connections $\mathbf{8}_I$, and a second switchgear part II having the outgoing connections $\mathbf{8}_{II}$. The incoming connections $\mathbf{8}_I$ and the outgoing connections $\mathbf{8}_{II}$ are each arranged in modular connection housings 12 that can be latched into the housing 11 of the electrical switchgear 1. For this purpose, latching means 121 (see FIG. 1(*b*)) are provided on the connection housings 12, which means latch into counter-latching means 111 (see FIG. 1(*b*)) of the housing 11.

The incoming and outgoing connections $\mathbf{8}_I$, $\mathbf{8}_{II}$ each comprise a clamping arrangement 8 (see FIG. 1(*e*)) having two spring-force terminals 81, 82 (see FIG. 1(*e*)) into each of which an electrical conductor 3 can be inserted. For each network line 33, there are therefore two spring-force terminals 81, 82, by means of which the network line 33 can be connected to the electrical switchgear 1.

For this purpose, the clamping arrangements 8 comprise a connection housing 12 in which an insertion opening 131, 132 for inserting the electrical conductor 3 is provided for each spring-force terminal 81, 82. The clamping arrangements 8 also comprise an actuation opening 141, 142, in parallel with the insertion opening 131, 132, for each spring-force terminal 81, 82. Furthermore, the clamping arrangements 8 each comprise a second actuation opening 143 for one of the spring-force terminals 81, 82, specifically for the second spring-force terminal 82 in this case.

FIG. 1(*b*) is a section through the upper housing part 18. The mirror-symmetrical arrangement of the incoming and outgoing connections $\mathbf{8}_I$, $\mathbf{8}_{II}$ can be seen.

Here the connection housings 12 of the clamping arrangements 8 are latched, by means of the latching means 121 thereof, to counter-latching means 111 of the housing 11.

By way of example, FIG. 1(*b*) shows electrical conductors 3 that comprise an electrically conductive wire 30 surrounded by an insulating coating 31. A stripped end 32 of the electrical conductor 3 is clamped in each of the clamping points K1, K2.

FIG. 1(*c*) is a perspective view of a section through a single clamping arrangement 8 of the electrical switchgear 1, arranged in the connection housing 12, and FIG. 1(*d*) is a side view of said section.

FIG. 1(*e*) to (*g*) show the clamping arrangement 8 without the connection housing 12. Each of FIGS. 1(*e*) and (*f*) is a perspective view, and FIG. 1(*g*) is a side view.

In the following, the clamping arrangement 8 will be described with reference to FIG. 1(*c*) to (*g*). Said clamping arrangement comprises the two spring-force terminals 81, 82, which will be referred to as the first spring-force terminal 81 and the second spring-force terminal 82 in the following. The two spring-force terminals 81, 82 each comprise a clamping cage 511, 512 and a spring 611, 612, which is arranged in the clamping cage 511, 512, respectively.

The clamping cage of the first spring-force terminal 81 will be referred to as the first clamping cage 511 in the following. The spring of the first spring-force terminal 81 will be referred to as the first spring 611 in the following. An electrical conductor 3 can be inserted into the first clamping cage 511 in an insertion direction, referred to as the first insertion direction 21 in the following. Said conductor is pushed into a first clamping point K1 between the first clamping cage 511 and the first spring 611 counter to the force of the first spring 611, and is clamped in the first clamping point K1 by means of the force of the first spring 611.

The clamping cage of the second spring-force terminal 82 will be referred to as the second clamping cage 512 in the following. The spring of the second spring-force terminal 82 will be referred to as the second spring 612 in the following. An electrical conductor 3 can be pushed into the second clamping cage 512 in a second insertion direction 22, which is oriented at an angle 9 to the first insertion direction 21. Said conductor is pushed into a second clamping point K2 between the second clamping cage 512 and the second spring 612 counter to the force of the second spring 612, and is clamped in the second clamping point K2 by means of the force of the second spring 612. It can be seen that the angle 9 is approximately a right angle in this case.

In the embodiment shown, the first and second spring-force terminals 81, 82 are arranged one behind the other in the first insertion direction 21. For this purpose, the clamping arrangement 8 comprises a busbar 50 that is electrically connected to the two clamping cages 511, 512. The first clamping cage 511 of the first spring-force terminal 81 and the second clamping cage 512 of the second spring-force terminal 82 are arranged on opposite sides of the busbar 50. As a result, the two spring-force terminals 81, 82 are arranged one above the other in the first insertion direction 21. As a result, the clamping arrangement 8 is very narrow.

The clamping cages 511, 512 each comprise a retaining wall 51 (see FIG. 1(*f*)) and a clamping wall 52 (see FIG. 1(*f*)). The springs 611, 612 also each comprise a retaining leg 61 (see FIG. 1(*c*)) and a clamping leg 62 (see FIG. 1(*c*)). They are approximately V-shaped. They are also each mounted around a pin-shaped bearing 171, 172 (see FIGS. 1(*b*) and (*c*)). The springs 611, 612 are supported on the retaining wall 51 of the clamping cage 511, 512 thereof when an electrical conductor 3 is clamped in one of the clamping points K1, K2.

In an initial state G of one of the spring-force terminals 81, 82 in which an electrical conductor 3 is not inserted in said spring-force terminal (see FIG. 1(*b*)), an open end 620 of the clamping leg 62 of the spring 611, 612 of the spring-force terminal 81, 82 preferably rests against the clamping wall 52 of the clamping cage 511, 512 of the spring-force terminal 81, 82. In a clamped state K in which the electrical conductor 3 is pushed in one of the spring-force terminals 81, 82, said conductor is clamped between the clamping wall 52 of the clamping cage 511, 512 of said spring-force terminal 81, 82 and the open end 620 (see FIG. 1(*d*)) of the clamping leg 62 of the spring 611, 612 of said spring-force terminal 81, 82. FIG. 1(*b*) shows, in the first housing part I, the spring-force terminals 81, 82 having an electrical conductor 3 inserted in each. Here the electrical conductors 3 are shown in the clamped state K. However, each of the spring-force terminals 81, 82 is shown here as the electrical conductors 3 are being released.

In order for an electrical conductor 3 inserted in one of the spring-force terminals 81, 82 to be released, the two spring-force terminals 81, 82 each comprise an operating element 711, 712 (see FIG. 1(*d*)). The spring 611, 612 of the spring-force terminal 81, 82 is opened by the operating element 711, 712. The operating element 711 of the first spring-force terminal 81 will also be referred to as the first operating element in the following. The operating element 712 of the second spring-force terminal 82 will also be referred to as the second operating element in the following.

The operating elements 711, 712 can each be actuated in the insertion direction 21, 22 associated with the spring-force terminal 81, 82 thereof. For this purpose, the operating elements 711, 712 are accessible via the actuation openings 141, 142 thereof, respectively. Said elements can then be moved in the insertion direction 21, 22 of the spring-force terminal 81, 82 thereof. When the operating elements 711, 712 are moved in the insertion direction 21, 22 of the spring-force terminal 81, 82 thereof, the clamping leg 62 of the spring 611, 612 of said terminal is pushed in said insertion direction 21, 22 such that the clamping point K1, K2 of the spring-force terminal 81, 82 of said element is opened. In the process, said leg is pivoted about the bearing 171, 172 thereof. An electrical conductor 3 pushed in one of the spring-force terminals 81, 82 can then be removed from said spring-force terminal 81, 82 by being withdrawn counter to the insertion direction 21, 22 associated with the spring-force terminal 81, 82.

In order to be actuated, the operating elements 711, 712 each comprise a first means 70 that is designed to be actuated by a tool 4, in this case a screwdriver. Here the first means 70 is designed as a notch and is provided for the tool 4 to engage therein. Said means is arranged on an operating end 74 arranged opposite the actuation end 72. The tool 4 is pushed into the notch 70 in the insertion direction 21, 22 of the spring-force terminal 81, 82, and the operating element 711, 712 is actuated by moving the tool 4 in said insertion direction 21, 22. This is shown in FIG. 1(*d*) for the first spring-force terminal 81.

Here the operating elements 711, 712 also comprise a second means 71. The second means 71 is designed as an integrally formed portion, in this case as a web. The web 71 is provided for the tool 4 to be placed thereagainst and for moving the operating element 711, 712 in the insertion direction of the spring-force terminal 81, 82 thereof.

However, in the present embodiment, the web 71 can only be used in the second spring-force terminal 82 (see FIG. 1(*d*)). Said terminal comprises the second actuation opening 143. The second actuation opening 143 of the second spring-force terminal 82 is arranged at the right angle 9 to the first actuation opening 142 of the second spring-force terminal 82, which first opening extends in parallel with the second insertion direction 22. The second actuation opening 143 therefore extends in the first insertion direction 21. Said opening is wide enough for the tool 4 to be placed against the web 71 at the angle 9 to the second insertion direction 22 and therefore in the first insertion direction 21. The second operating element 712 can therefore be actuated via the first actuation opening 142 thereof at the angle 9 to the first insertion direction 21. Said element can therefore be actuated via the first actuation opening 142 thereof in the second insertion direction 22. Said element can also be operated via the second actuation opening 143 in the first insertion direction 21.

Once the tool 4 has been placed against the web 71, the operating element 712 can be moved in the second insertion direction 22 by means of a lever movement. For this purpose, the tool 4 is rotated in a rotational direction 24 about an axis of rotation 25 that extends in an extension direction 23 perpendicular to the first and second insertion directions 21, 22. The axis of rotation 25 is arranged at a contact point P of the tool 4 against the connection housing 12, specifically at an end 144 of the second actuation opening 143.

The second spring-force terminal 82 can therefore be actuated both in the second insertion direction 22 and at the right angle 9 to the second insertion direction 22, i.e. in the first insertion direction 21.

In order to prevent the operating elements 711, 712 from being pushed out of the spring-force terminal 81, 82 thereof by the springs 611, 612, in particular by the clamping leg 62 of the springs 611, 612, the operating elements 711, 712 each comprise an edge 73 that cooperates with a stop 15 of the connection housing 12. In the initial state G, the edge 73 of the operating elements 711, 712 is, in each case, pushed against the stop 15 by the spring 611, 612 of the spring-force terminal 81, 82 of said element, and therefore said elements cannot slide out of the actuation opening 141, 142 thereof.

In the electrical switchgear 1 in FIG. 1, the connection housings 12 of the two switchgear parts I, II are grouped in each case such that each of the connection housings 12 comprise all incoming or outgoing connections $\mathbf{8}_I$, $\mathbf{8}_{II}$. In contrast, although the electrical switchgear 1 in FIG. 2 comprises a total of five incoming and five outgoing connections $\mathbf{8}_I$, $\mathbf{8}_{II}$, the connection housings 12 of the electrical switchgear 1 in FIG. 2 are not grouped and each comprise only a single incoming or outgoing connection $\mathbf{8}_I$, $\mathbf{8}_{II}$.

The electrical switchgears in FIGS. 1 and 2 also differ in terms of the clamping arrangement 8. The first clamping cage 511 and the second clamping cage 512 of the clamping arrangement 8 in FIG. 1 are made in one piece with the busbar 50. In contrast, the first clamping cage 511 and the second clamping cage 512 of the clamping arrangement 8 in FIG. 2 are connected to the busbar 50 in an integrally bonded manner, in particular by means of welding. Besides this, the clamping cages 51, 52 of said clamping arrangement 8 are made in structurally the same manner and are merely fastened to opposite sides of the busbar 50 in a manner rotated through the angle 9 with respect to one another.

Furthermore, the operating elements 711, 712 of the clamping arrangements 8 in FIG. 2 do not each comprise an additional second means 71 in order to actuate said elements through the second actuation opening 143. Rather, for this purpose the tool 4 is placed against the operating end 74 in this embodiment of the operating elements 711, 712. The operating end 74 also comprises an edge that can be used to move the operating elements 711, 712.

In this embodiment of the clamping arrangement 8 too, the second spring-force terminal 82 comprises two actuation openings 142, 143 for actuating the operating element 712 thereof (see FIG. 2(*b*)). In order to be actuated, the second actuation opening 143 of the second spring-force terminal 82 widens. The tool 4 can thereby be inserted behind the operating element 712 of the second spring-force terminal 82 through the second actuation opening 143. By means of the lever movement, the operating element 712 of the incoming connections $\mathbf{8}_I$ or the outgoing connections $\mathbf{8}_{II}$ can be moved in or counter to the second insertion direction 22, respectively. In this case too, the clamping leg 62 of the spring 612 is, in the process, pushed in or counter to the second insertion direction 22 such that the second clamping point K2 opens.

Electrical conductors 3 can be connected to the clamping arrangements 8 both from above and below, and from the front after the electrical switchgears 1 according to the invention have been attached to a distribution board wall. The user therefore has the choice between the mode of connection from above or below, which is usually possible in the case of screw connections, and the mode of connection from the front, which is usually used in the case of spring-force terminals 8. This serves the wishes of the user in respect of the mode of connection as best as possible.

Figure 3:
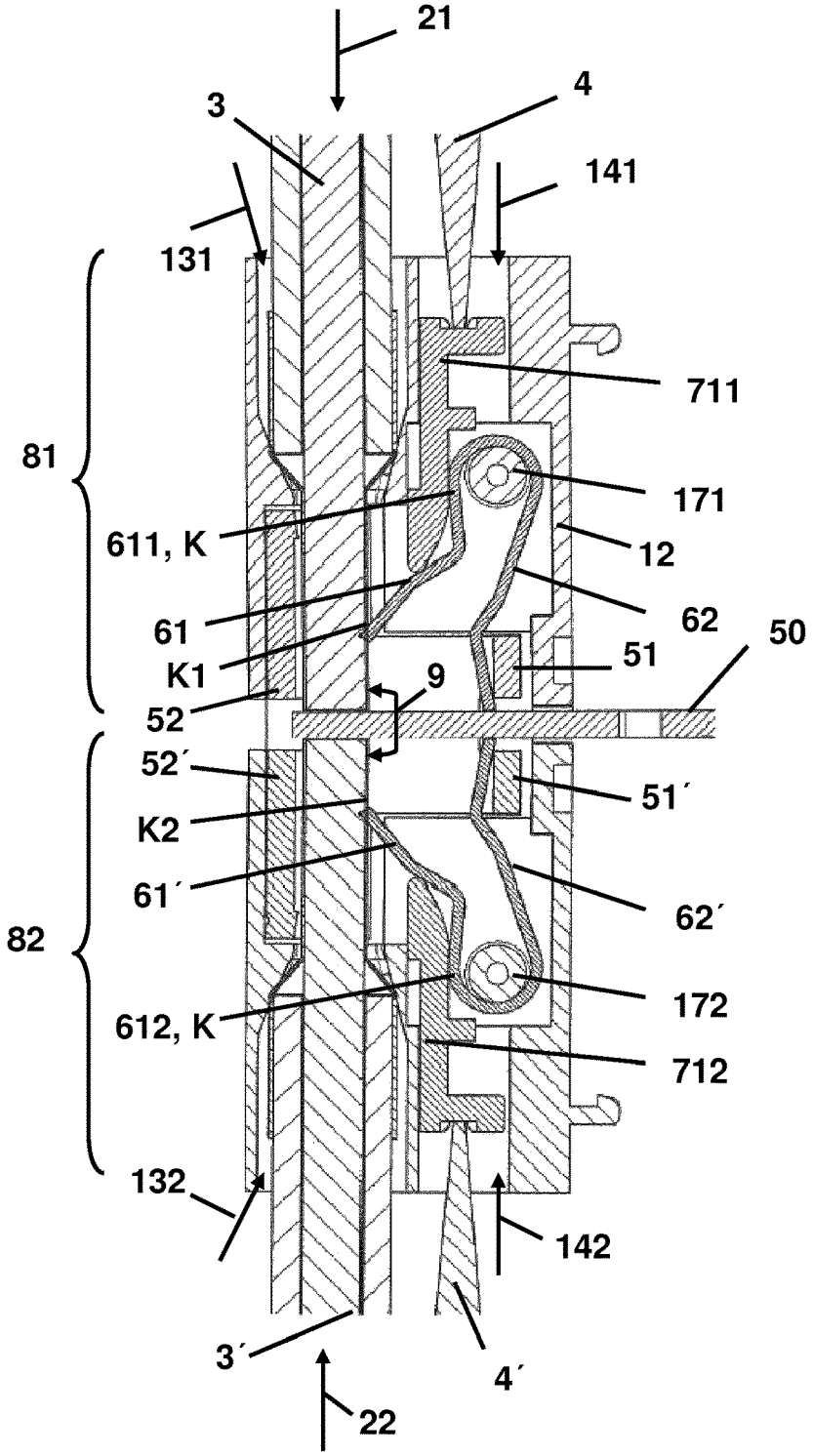
FIG. 3 is a sectional image of a further embodiment of a clamping arrangement of an electrical switchgear.

FIG. 3 shows a further embodiment of a clamping arrangement 8 for an electrical switchgear 1. This clamping arrangement 8 also comprises two spring-force terminals 81, 82. However, said terminals are arranged at an angle 9 of 180° to one another. In the embodiment shown, said terminals are also arranged in alignment one above the other. In this case, the spring-force terminals can therefore be actuated in opposite directions. Electrical conductors can also be inserted into the spring-force terminals in opposite insertion directions 21, 22. The insertion directions 21, 22 are oriented counter to one another.

The spring-force terminals 81, 82 each comprise a spring 611, 612 and a clamping cage 511, 512. The retaining wall 51 and the clamping wall 52 of the clamping cages 511, 512 can be seen here.

The clamping arrangement 8 comprises a busbar 50. The busbar 50 and clamping cages 511, 512 of the spring-force terminals 81, 82 are made in one piece in this case. As a result, the spring-force terminals 81, 82 are arranged in mirror symmetry with respect to the common busbar 50.

In FIG. 3, electrical conductors 3 are inserted in each of the spring-force terminals 81, 82. The electrical conductors 3 are pushed, by means of the clamping leg 62 or 62' of the clamping springs 611, 612, against the clamping wall 52 of the clamping cage 511, 512 of said springs. Actuation tools 4 are shown for both spring-force terminals 81, 82, which are provided to push the operating element 711, 712 of the spring-force terminals 81, 82 in the actuation directions 21, 22.

The first spring-force terminal 81 comprises the first insertion opening 131. The electrical conductor 3 can be inserted into the first spring-force terminal 81 in the first insertion direction 21 via the first insertion opening 131. The first spring-force terminal 81 also comprises the first actuation opening 141. The actuation tool 4 can be inserted into the first spring-force terminal 81 in the first actuation direction, which extends in parallel with the first insertion direction 21, via the first actuation opening 141.

The first spring-force terminal 81 comprises the first operating element 711, which is provided for releasing the electrical conductor 3 inserted in the first spring-force terminal 81. The first operating element 711 is accessible via the first actuation opening 141. For this purpose, said element can be moved in the first actuation direction, i.e. in parallel with the first insertion direction 21, in particular by means of the actuation tool 4. When the first operating element 711 is moved, the clamping leg 61 of the first spring 611 is pushed in the first insertion direction 21 by means of the first operating element 711. In the process, the clamping leg 61 of the first spring 611 is pivoted about the first bearing 171. As a result, the first clamping point K1 opens. An electrical conductor 3 inserted in the first spring-force terminal 81 can then be removed therefrom by being withdrawn counter to the first insertion direction 21.

The second spring-force terminal 82 comprises the second insertion opening 132. The electrical conductor 3' can be inserted into the second spring-force terminal 82 in the second insertion direction 22, which extends counter to that of the first insertion opening 21 in this case. The second spring-force terminal 82 also comprises the second actuation opening 142. The actuation tool 4' can be inserted into the second spring-force terminal 82 in the second actuation direction, i.e. counter to the first insertion direction 21, via the second actuation opening 142.

The second spring-force terminal 82 comprises a second operating element 712, which is provided to release an electrical conductor 3' inserted in the second spring-force terminal 82. The second operating element 712 is accessible via the second actuation opening 142. For this purpose, said element can be moved in the second actuation direction, i.e. in parallel with the second insertion direction 22 and counter to the first insertion direction 21, in particular by means of the actuation tool 4'. When the second operating element 712 is moved, the clamping leg 61' of the second spring 612 is pushed in the second insertion direction 22 by means of the second operating element 712. In the process, the clamping leg 61' of the second spring 612 is pivoted about the second bearing 172. As a result, the second clamping point K2 opens. An electrical conductor 3 inserted in the second spring-force terminal 82 can then be removed therefrom by being withdrawn counter to the second insertion direction 22.

On account of the arrangement at the angle 9 of 180° and in alignment one above the other, the insertion and actuation directions 21, 22 of the two spring-force terminals 81, 82 each extend in opposite directions. The electrical conductors 3 and 3' can therefore be connected and released in the opposite directions.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 electrical device, electrical switchgear
11 housing
111 counter-latching means
12 connection housing
121 latching means
131, 132 first/second insertion opening
141, 142, 143 first/second/third actuation opening
144 end of the second actuation opening
15 stop
161 joining means
162 fastening means, through-hole
171, 172 first/second bearing, pin
18 upper housing part
19 lower housing part
21 first insertion direction, first extension direction
22 second insertion direction, second extension direction
23 third extension direction
24 rotational direction
25 axis of rotation
3, 3' electrical conductor
30 electrically conductive wire
31 casing
32 stripped end
33 network line
4, 4' actuation tool, screwdriver
5 contact component
50 busbar, first/second busbar
511, 512 first/second clamping cage
51, 51' retaining wall
52, 52' clamping wall
53 connection wall
611, 612 first/second spring
61, 61' retaining leg
610 retaining end
62, 62' clamping leg
620 clamping end
711, 712 first/second operating element
70 first means, recess, notch
71 second means, integrally formed portion, web
72 actuation end
73 stop, edge
74 operating end
8 clamping arrangement
81, 82 first/second spring-force terminal
9 angle
G initial state
K clamped state
K1 first clamping point
K2 second clamping point
S mirror plane
I first switchgear part
II second switchgear part
P contact point

The invention claimed is:

1. A clamping arrangement comprising:

two spring-force terminals, the two spring-force terminals each comprising a clamping cage and a spring, each of the two clamping cages being configured to receive an electrical conductor pushed in an insertion direction and to clamp the conductor between the cage and the spring, a first insertion direction of a first of the two spring-force terminals and a second insertion direction of a second of the two spring-force terminals being arranged at an angle larger than 0° to one another, wherein the two spring-force terminals are arranged one behind the other in one of the insertion directions of the electrical conductor, wherein the first insertion direction of the first of the two spring-force terminals and the second insertion direction of the second of the two spring-force terminals are arranged at a right angle to one another or counter to one another, and wherein each spring-force terminal comprises an operating element slidable along the insertion direction associated with the spring-force terminal to open the spring, each of the operating elements being actuatable in the insertion direction associated with the spring-force terminal thereof, and at least one of the operating elements being actuatable at an angle to the insertion direction associated with the spring-force terminal thereof.

2. The clamping arrangement according to claim 1, wherein the two spring-force terminals are arranged so as to overlap one another at least in part or one above the other in one insertion direction.

3. The clamping arrangement according to claim 1, wherein the first clamping cage of the first spring-force terminal and the second clamping cage of the second spring-force terminal are arranged on opposite sides of a busbar.

4. The clamping arrangement according to claim 1, wherein the spring-force terminals are arranged on opposite sides of a busbar.

5. The clamping arrangement according claim 1, wherein the spring-force terminals are arranged at the right angle to one another or so as to be rotated through 180° with respect to one another.

6. The clamping arrangement according to claim 1, wherein the first clamping cage and the second clamping cage are electrically connected to a busbar or are made in one piece with the busbar.

7. The clamping arrangement according to claim 6, wherein the first clamping cage and the second clamping cage are electrically connected to the busbar in an integrally bonded manner.

8. The clamping arrangement according to claim 1, further comprising a connection housing in which an insertion opening for inserting an electrical conductor and an actuation opening for actuating the operating element are provided for each of the two spring-force terminals, the insertion opening and the actuation opening of the same spring-force terminal being, in each case, arranged in parallel with one another and at an angle to the insertion opening and the actuation opening of the other spring-force terminal.

9. The clamping arrangement according to claim 8, wherein the connection housing comprises, for at least one of the two spring-force terminals, a second actuation opening that extends at the angle to the insertion opening associated with the spring-force terminal thereof.

10. A spring-force terminal for the clamping arrangement according to claim 1, the terminal comprising:

a clamping cage;

a spring;

an operating element configured to open the spring, the clamping cage being configured to receive an electrical conductor pushed in an insertion direction and to removably clamp the conductor between the clamping cage and the spring;

a first actuation opening configured for actuating the operating element, which extends in parallel with the insertion direction; and a second actuation opening configured for actuating the operating element and which extends at a right angle to the first actuation opening such that the operating element is configured to be actuated both in the insertion direction and at a right angle to the insertion direction, wherein the operating element is displaceable in and against the insertion direction by the first and second actuation openings.

11. The spring-force terminal according to claim 10, wherein the operating element comprises a first actuator in order to be actuated in the insertion direction, and a second actuator in order to be actuated at the angle to the insertion direction.

12. A switchgear comprising at least one clamping arrangement according to claim 1.

13. The switchgear according to claim 12, further comprising two clamping arrangements that are arranged in mirror symmetry with respect to a mirror plane.

14. The switchgear according to claim 13, further comprising an electrical assembly configured to protect an electrical load, the switchgear being connectable to an electrical network, wherein one clamping arrangement comprises an incoming electrical connection for at least one electrical network line in the network, and the other clamping arrangement comprises an outgoing electrical connection for the network line in the network.

15. The switchgear according to claim 14, further comprising an upper housing part and a lower housing part, the clamping arrangement or the clamping arrangements being arranged in the upper housing part, and the electrical assembly being arranged in the lower housing part.

* * * * *